United States Patent [19]

Laing et al.

[11] Patent Number: 4,703,748

[45] Date of Patent: Nov. 3, 1987

[54] DESTRATIFIER FOR HOT WATER TANKS

[76] Inventors: Inge Laing, 1253 La Jolla Rancho Rd., La Jolla, Calif. 92037; Oliver P. Laing; Karsten A. Laing, both of 3970 Honeycutt St., San Diego, Calif. 92109; Birger J. Laing, Hofenerweg 37, Remseck-2, Fed. Rep. of Germany, 7148

[21] Appl. No.: 828,986

[22] Filed: Feb. 13, 1986

[51] Int. Cl.[4] ..... F24H 1/00

[52] U.S. Cl. ..... 126/362; 417/420; 165/109.1; 126/387; 122/411

[58] Field of Search ..... 417/420, 32; 126/387, 126/379, 361, 362; 165/132, 109.1; 122/380, 411

[56] References Cited

U.S. PATENT DOCUMENTS 775,144 11/1904 Mathie ..... 126/387 X 2,518,597 8/1950 Brooks ..... 417/32

3,285,331 11/1966 Braflaned ..... 165/109.1

3,302,700 2/1967 Dugan ..... 165/109.1

4,352,646 10/1982 Laing et al. ..... 417/420

FOREIGN PATENT DOCUMENTS 39801 3/1977 Japan ..... 417/32

*Primary Examiner*—Margaret A. Focarino

[57] ABSTRACT

A fluid flow machine consisting of a stator, mounted underneath a hot water tank, and an armature-impeller unit arranged inside said hot water tank, being separated from said stator by a spherical, magnetically permeable separation wall, which generates a toroidal vortex inside the water tank. Said vortex conveys hot water from the upper region of the tank to its lower region until the whole tank is filled with water of a uniform temperature.

3 Claims, 4 Drawing Figures

DESTRATIFIER FOR HOT WATER TANKS

BACKGROUND OF THE INVENTION

The invention is concerned with a device to produce internal circulation in hot water tanks and hot water heaters.

In large domestic hot water tanks, it is common to convey water from the upper part to the lower part of the tank by means of a circulation pump. This ensures that the cold water in the bottom part of the tank will also be heated. In this manner, the heat content of the storage tank can be considerably increased. The disadvantage of this method is that conventional circulation pumps must be used. These have high electricity consumption, have a tendency to seize, and lead to mixing of the various temperature zones irrespective of the temperature profile within the tank. If a large portion of the stored water is still cold, such mixing leads to an unacceptably large temperature drop in the upper zone of the tank, which feeds the hot water system.

SUMMARY OF THE INVENTION

The invention refers to a destratifier that avoids this disadvantage of mixing the water in generating a toroidal vortex that extends vertically upward through the storage tank. The toroidal vortex is produced by a rotating impeller, which is located at the bottom of the tank. The impeller pushes cold water at the bottom radially outward toward the tank wall. The radially-accelerated water turns upward at the tank wall and flows upward along the inside wall of the tank. At the same time, water from the top of the tank is drawn downward around the center axis to relace the upward moving cold water. Thus, the overall movement of water follows the shape of a toroidal vortex.

The hot water around the center axis flows from the waterbody in the upper zone downward against the buoyant forces of the hot water present in the lower water zones. The larger the temperature difference between the hot water drawn from the upper zone and the cold water lying below it, the larger is the buoyancy of the hot water that opposes the suction downward. Thus, the uppermost portion will no longer participate into the mixing process. The speed of the stream tubes of water flowing upward along the inside wall determines the amount of heat transferred to the upward moving mass of water. The increasing temperature of the upward moving water should not exceed the desired storage temperature. When the upward moving stream tubes have reached the prescribed temperature, they become part of the upper zone of water already at final temperature. The interfacial front of the upper zone moves downward until the driving motor of the impeller becomes surrounded by hot water. Then, a thermostat locted within the motor switches the motor off, until interflowing cold water that replaces used hot water causes the motor to switch on again.

The same destratifier can be used when hot spots in heat carrying surfaces cause boiling in stagnant liquid. In such case, the axis of the vortex is directed toward the regions threatened by overheating.

BRIEF DESCRIPTION OF THE DRAWING

The invention is described with the aid of the following figures.

DESCRIPTION OF THE PREFERRED EMBODIMENTS

Figure 1:
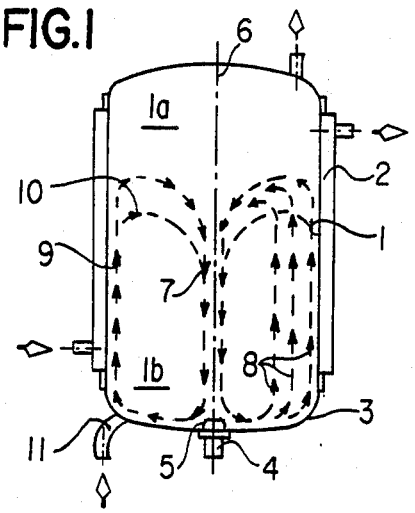
FIG. 1 shows a hot water tank, in which a destratifier is mounted at the bottom.

FIG. 1 shows a hot water tank in which the water in the upper zone (1*a*) has already been heated by the heating jacket (2) through which the heat carrier flows. The lower zone (1*b*) is still cold. The destratifier (4, 5) is mounted at the center of the tank bottom (3). Its impeller (5) produces a vortex around the vertical axis (6). Hot water flows downward along the path of arrow (7), and is pushed by the impeller as shown by arrow (8) toward the heated inside wall of tank (1). Because of its lower density, it rises upward according to arrow (9) through the cold water zone. In addition to the radial acceleration the impeller (5) gradually brings the entire water content of tank (1) into slow rotation. The stream tubes that are drawn downward along the path of arrow (7) are accelerted radially outward along arrow (8) and rise according to arrow (9) while being heated. Thus, an interface (10) forms between the body of hot water in the upper zone (1*a*) and the cooler, lower zone (1*b*). The interface (10) progresses downward during heating of the tank contents.

Without the action of the destratifier, the rate of heat transfer between the heating jacket (2) and the lower zone (1*b*) decreases and approaches zero as the body of hot water increases in depth. On the other hand, the toroidal vortex (7, 8, 9, 10) of the destratifier (4, 5) conveys cold water even from the lowest layer in the lower zone (1*b*). A thermostat (54) mounted within the motor (4) switches the motor off until new cold water enters through the inlet pipe (11). Heat transfer ceases only when the water also at the very bottom if the tank has reached the prescribed storage temperature.

Figure 2:
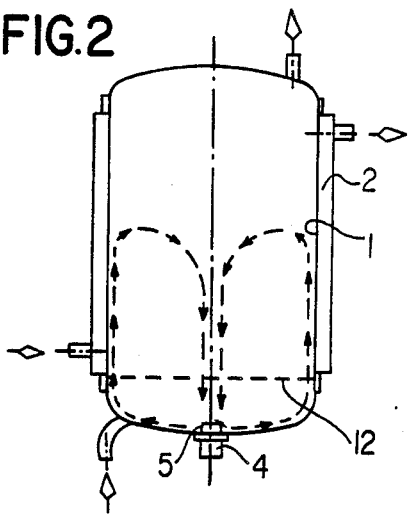
FIG. 2 shows the toroidal vortex pattern in a tank nearly filled with hot water.

FIG. 2 shows the stream lines of the toroidal vortex in the hot water tank (1) in which most of the water is at the prescribed final temperature. Previously, in conventional systems, the mass of water below plane (12) received no heat from the heating jacket (2), and there was very little heat transfer between the zones above plane (12) and the remaining area of contact with the inside jacket surface. In contrast, the destratifier enables the entire water content of the tank to be heated. In this manner, the heat content of the fully heated tank increases by about 50%. Because the outside surface area of the tank remains unchanged, there is no increase in heat losses to the surroundings. Because of the decrease in surface area of the tank required for a given amount of heat storage, the destratifier results in energy savings.

Figure 3:
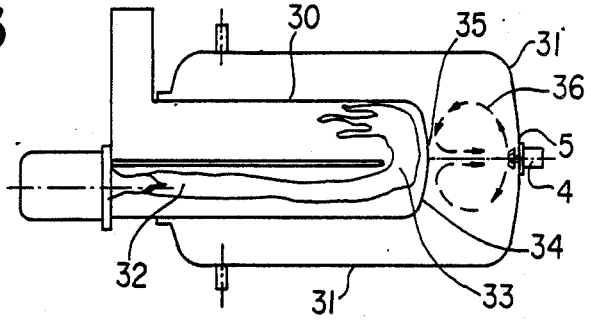
FIG. 3 shows the utilization of the destratifier in a gas-fired hot water heater.

FIG. 3 illustrates application of the destratifier in a gas-fired hot water heater. The combustion chamber (30) is surrounded by a jacket of water in the vessel (31). The flame (32) is in contact with the back wall (31') of the combustion chamber (30) in the region of the turn around (33). The flame (32) produces such a high local temperature that boiling occurs. The destratifier (4, 5) mounted on the back wall (31') produces a toroidal vortex (36) that causes such a high relative velocity in region (35) that the boiling temperature is no longer achieved.

Figure 4:
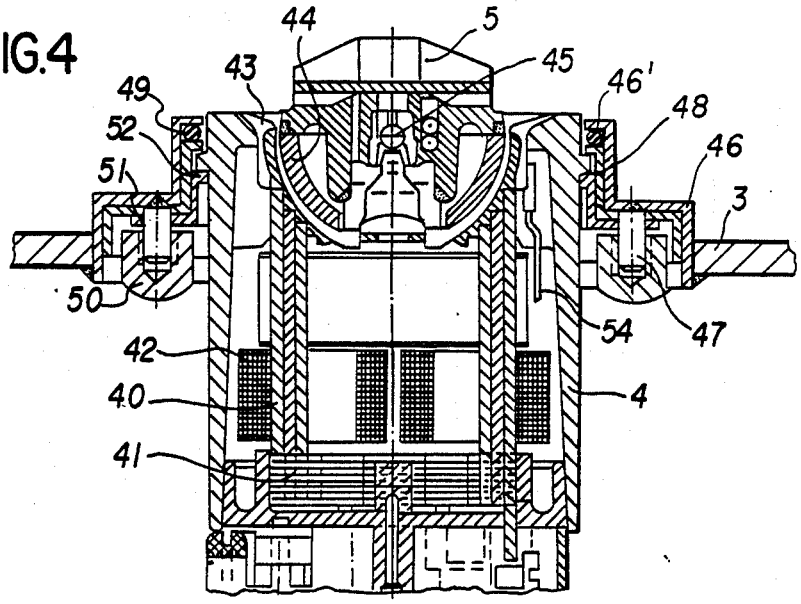
FIG. 4 shows a cross-section of a destratifier.

FIG. 4 shows a cross-sectional view of the destratifier according to the invention. The motor (4) is composed of a stator comprising teeth (40), a short-circuiting yoke (41), and of coils (42). The rotating magnetic field of the stator passes through the magnetically permeable separation wall (43) and drives the pole ring (44). The pole ring (44) and the impeller (5) form a rotating unit that is centered and supported by a ball (45), which in turn forms a unit with the separation wall (43).

A ring (46) is welded to the bottom (3) of the tank. Thread bolts (47) are butt welded to the surface of the ring (46). The distance ring (48) and the collar (46') of the ring (46) form a groove for the rubber-elastic O-ring (49). The counter ring (51) is pressed against the rim (52) of the motor (4) by the nuts (50), which simultaneously mount the distance ring (48) and the motor (4) to the tank.

I claim:

1. A fluid flow machine for inhibiting thermal stratification in a hot water tank, characterized in that an electric motor, consisting of a stator (4), with windings (40) is mounted on the outside of the bottom (3) of the tank (1) and an armature (44), supported in the center by a ball (45), said armature being situated inside the tank (1) and separated from the stator (4) by a magnetically permeable separation wall (43), said armature (44) forming a unit with an impeller (5) which pushes water in the lower zone (1*b*) of the tank (1) radially outward toward the wall of the tank (1), forming a toroidal vortex (7,8) whose center region (7) draws hot water from the water body in the upper zone (1*a*) of the tank (1) downward, replacing said radially pushed cold water, which is moving upward from the lower zone (1*b*) to said upper zone (1*a*).

2. A fluid flow machine as per claim 1, characterized in that the motor (4) is switched on by a thermostat (52) as soon as the temperature of the water surrounding the impeller (5) falls below a predetermined temperature.

3. A fluid flow machine as per claim 1, characterized in that the motor (4) is mounted between two rings (46,51), of which the inner ring (46) is permanently fixed to the tank wall (3,31) and the outer ring (51) is held against a rim (52) of the motor (4) by means of bolts (47,50) distributed along the circumference of the ring (51).

* * * * *